US006223492B1

(12) United States Patent
Barnhart, Jr. et al.

(10) Patent No.: US 6,223,492 B1
(45) Date of Patent: May 1, 2001

(54) ALIGNMENT AND SPACER APPARATUS AND SIDING PANEL INSTALLATION SYSTEM

(76) Inventors: David E. Barnhart, Jr.; Dina C. Sherman, both of 10 S. Montgomery St., Walden, NY (US) 12586

( * ) Notice: Subject to any disclaimer, the term of this patent is extended or adjusted under 35 U.S.C. 154(b) by 0 days.

(21) Appl. No.: 09/565,118

(22) Filed: May 4, 2000

(51) Int. Cl.[7] ..... E04D 1/34

(52) U.S. Cl. ..... 52/551; 52/543; 52/546; 52/748.11; 52/749.1

(58) Field of Search ..... 52/518, 520, 521, 52/522, 536, 543, 551, 550, 545, 546, 549, 748.1, 748.11, 749.12

(56) References Cited

U.S. PATENT DOCUMENTS

| | | | | |
|---|---|---|---|---|
| 1,163,034 | * | 12/1915 | Pippen | 52/551 |
| 1,557,616 | * | 10/1925 | Riley | 52/546 X |
| 1,925,939 | * | 9/1933 | Sherman | 52/551 X |
| 1,940,936 | * | 12/1933 | Black | 52/551 X |
| 2,848,763 | * | 8/1958 | Schurger et al. | 52/553 X |
| 2,877,879 | * | 3/1959 | Johnson | 52/546 |
| 3,131,513 | * | 5/1964 | Grigas et al. | 52/551 X |
| 3,236,932 | * | 2/1966 | Grigas et al. | 52/551 X |
| 3,326,016 | * | 6/1967 | Koenigshof | 52/551 X |
| 3,347,009 | * | 10/1967 | Meddick | 52/545 |
| 3,589,085 | | 6/1971 | Sickler . | |
| 3,596,420 | | 8/1971 | Ducker . | |
| 4,047,349 | * | 9/1977 | Aguilar, Jr. | 52/551 |
| 4,134,244 | | 1/1979 | Sjölander . | |
| 4,272,937 | | 6/1981 | Brugman . | |
| 4,288,958 | * | 9/1981 | Chalmers et al. | 52/551 X |
| 4,538,391 | | 9/1985 | Skrabis et al. . | |
| 4,555,879 | | 12/1985 | Cheater . | |
| 5,349,802 | * | 9/1994 | Kariniemi | 52/543 |
| 5,950,321 | | 9/1999 | PeÑa et al. . | |
| 6,044,609 | * | 4/2000 | Kim | 52/551 |

FOREIGN PATENT DOCUMENTS

| | | | | |
|---|---|---|---|---|
| 1569562 | * | 4/1969 | (FR) | 52/551 |

* cited by examiner

*Primary Examiner*—Richard Chilcot
(74) *Attorney, Agent, or Firm*—Blank Rome Comisky & McCauley LLP

(57) ABSTRACT

An alignment and spacer apparatus includes an elongated body member that extends longitudinally along and laterally from a longitudinal axis. The elongated body member has an arcuate surface and a flat surface facing opposite the arcuate surface. The arcuate surface curves about the longitudinal axis and has a longitudinally extending crown. Further, the body member includes at least one stop tab that projects from the arcuate surface to define a stop tab surface. The stop tab surface extends laterally and perpendicularly relative to the longitudinal axis and at least a portion of the stop tab surface protrudes above the crown. Also described is a siding panel installation system for installing siding panels on a support structure which includes a plurality of elongated body members. Each body member includes a sequence of stop tabs that are spaced equidistantly apart from one another and project from the arcuate surface. The plurality of body members are disposed apart from one another in a parallel relationship and are arranged to form a series of rows of stop tabs for urging abutment of respective top linear edges of the siding panels to a respective row of stop tabs.

18 Claims, 4 Drawing Sheets

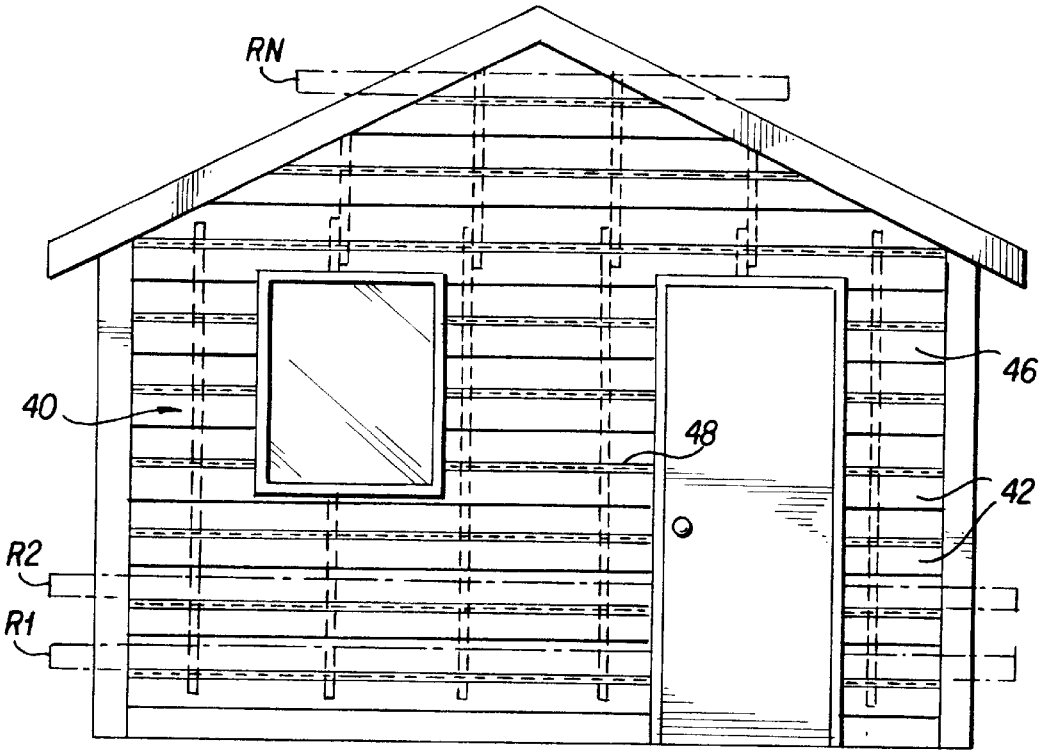
FIG. 5
FIG. 6
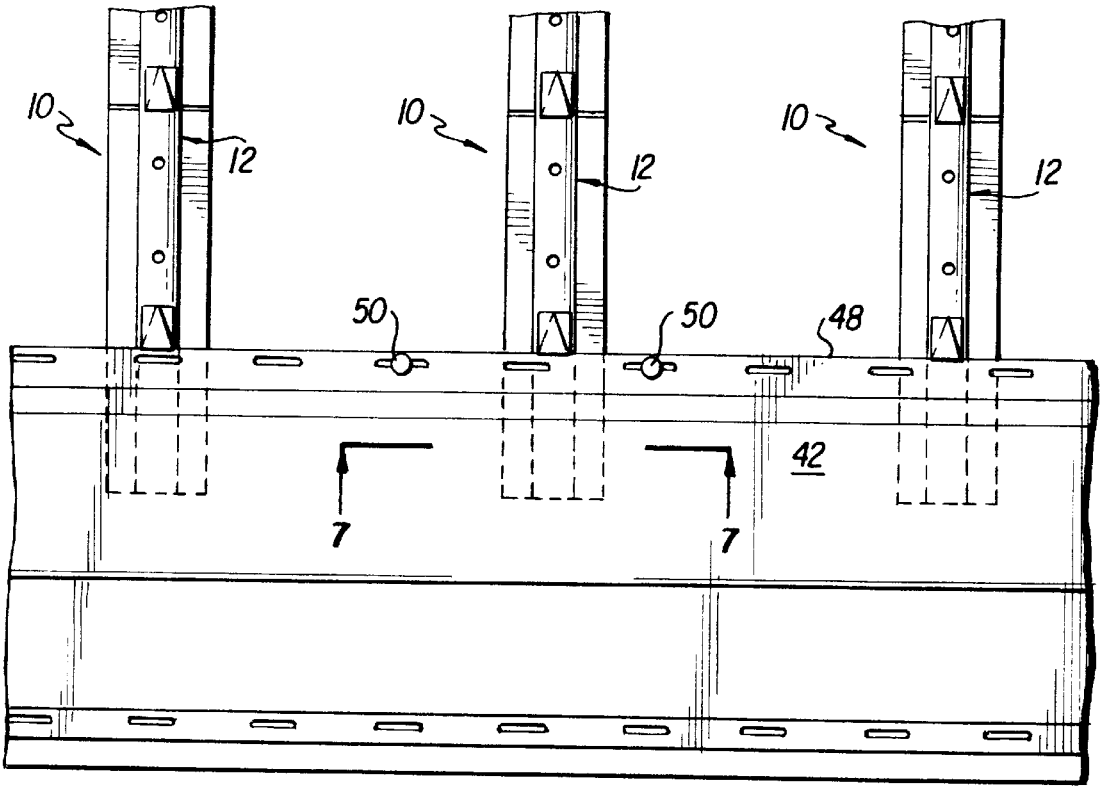

ALIGNMENT AND SPACER APPARATUS AND SIDING PANEL INSTALLATION SYSTEM

FIELD OF THE INVENTION

The invention relates to a siding panel installation system and an alignment and spacer apparatus used for installing siding panels onto a support structure.

BACKGROUND OF THE INVENTION

Many different types of building materials are available for constructing building structures such as houses. When selecting building materials for the support walls, a builder chooses these materials based upon cost, durability and aesthetics. The types of building materials considered for support walls include brick, wood, clapboard, stucco and siding panels. Two popular types of siding panels are aluminum siding panels and vinyl siding panels.

In an effort to decrease construction cost, a variety of systems have been used to simplify installation of siding panels. In U.S. Pat. No. 3,236,932 to Grigas et al, elongated metal strips are used for applying metallic siding panels to a building structure without the use of nails or other fasteners penetrating the siding panels. Thus, no holes are formed into the siding panels. Each of the elongated metal strips has a central box portion with side flanges containing holes. The metal strips are fastened with nails or screws along the flanges to the support wall. The strips also have vertically spaced clips for engaging the upper and lower edges of the siding panels.

U.S. Pat. No. 3,596,420 to Ducker illustrates a metal mounting strip for mounting siding panels. The metal mounting strip includes a plurality of equally-spaced anchor tabs having oppositely directed tongues that receive respective edges of two siding panels. The siding panels are simply and easily mounted to and disassembled from the metal mounting strips without forming holes into the siding panels.

U.S. Pat. No. 4,047,349 to Aguilar, Jr. teaches a sheet material attaching device for securing siding panels to a building. The attaching device is a longitudinal strip constructed from bendable sheet metal or plastic with support tabs which are integrally stamped-out segments of the strip. Preformed slots in the siding panel are engaged with the bendable support tabs which are then bent to secure the siding panel to the sheet material attaching device.

U.S. Pat. No. 4,288,958 to Chalmers et al. discloses a horizontal siding panel system with vertical stringers for holding top margins of the siding panels. The vertical stringers have vertically spaced resilient clips that cooperate with the panel top margin to provide a double locking arrangement. Each stringer is an elongated metal strip having longitudinally stiffening ribs formed along both side edges and a flat central web punched at intervals along its length to provide holes for nails or screws which secure the stringer to the wall.

There is a need in the siding panel installation industry to provide a rapid yet accurate system for installing siding panels onto a support structure. It would be beneficial of this system could be simple and afford an installer a capability of sliding the siding panels horizontally for horizontal alignment under reduced friction before fastening the siding panel. The present invention satisfies this need and provides these benefits.

SUMMARY OF THE INVENTION

It is an object of the invention to provide a siding panel installation system including a plurality of alignment and spacer apparatuses that simplifies installation of siding panels onto a support structure.

It is another object of the invention to provide a siding panel installation system including a plurality of alignment and spacer apparatuses that provides more rapid installation and more accurate alignment of siding panels onto a support structure.

Yet another object of the invention to provide a siding panel installation system including a plurality of alignment and spacer apparatuses that enables an installer to slide the siding panels horizontally at a reduced amount of friction compared to conventional methods of siding panel installation.

Accordingly, an alignment and spacer apparatus of the invention is hereinafter described. The alignment and spacer apparatus of the invention includes an elongated body member that extends longitudinally along and laterally from a longitudinal axis. The elongated body member has an arcuate surface and a flat surface facing opposite the arcuate surface. The arcuate surface curves about the longitudinal axis and has a longitudinally extending crown. Further, the body member includes at least one stop tab that projects from the arcuate surface to define a stop tab surface. The stop tab surface extends laterally and perpendicularly relative to the longitudinal axis and at least a portion of the stop tab surface protrudes above the crown.

Another embodiment of the invention is an a siding panel installation system that is used for installing siding panels onto a support structure with each siding panel having a linear top edge. The siding panel installation system includes a plurality of the elongated body members described above. Additionally, each body member includes a sequence of stop tabs that are spaced equidistantly apart from one another and project from the arcuate surface. The plurality of body members are disposed apart from one another in a parallel relationship and are arranged to form a series of rows of stop tabs. Each series includes one stop tab from each body member and these stop tabs are linearly aligned with each other. Each body member is connected to the support structure in a facially opposing relationship with the flat surfaces. When each one of the siding panels is disposed crosswise relative to the plurality of connected body members and in contact with the respective crowns, the linear top edge of respective ones of the siding panels is urged to abut the stop tab surfaces in a respective row. Thus, the siding panel installation system assures horizontal alignment of each siding panel before connecting each siding panel to the support structure and provides a spacer between each connected siding panel and the support structure.

BRIEF DESCRIPTION OF THE DRAWINGS

These and other objects of the invention will become more readily appreciated and understood from consideration of the following detailed description of the exemplary embodiments of the invention when taken together with the accompanying drawings, in which:

FIG. 5 is a front elevational view of side of a house with a siding panel installation system of the invention including a plurality of alignment and spacer apparatuses with siding panels mounted thereto.

FIG. 6 is an enlarged front elevational view of the house and the siding panel installation system of the invention including the plurality of alignment and spacer apparatuses with the siding panels mounted thereto as shown in FIG. 5.

DETAILED DESCRIPTION OF THE EXEMPLARY EMBODIMENTS

Figure 1:
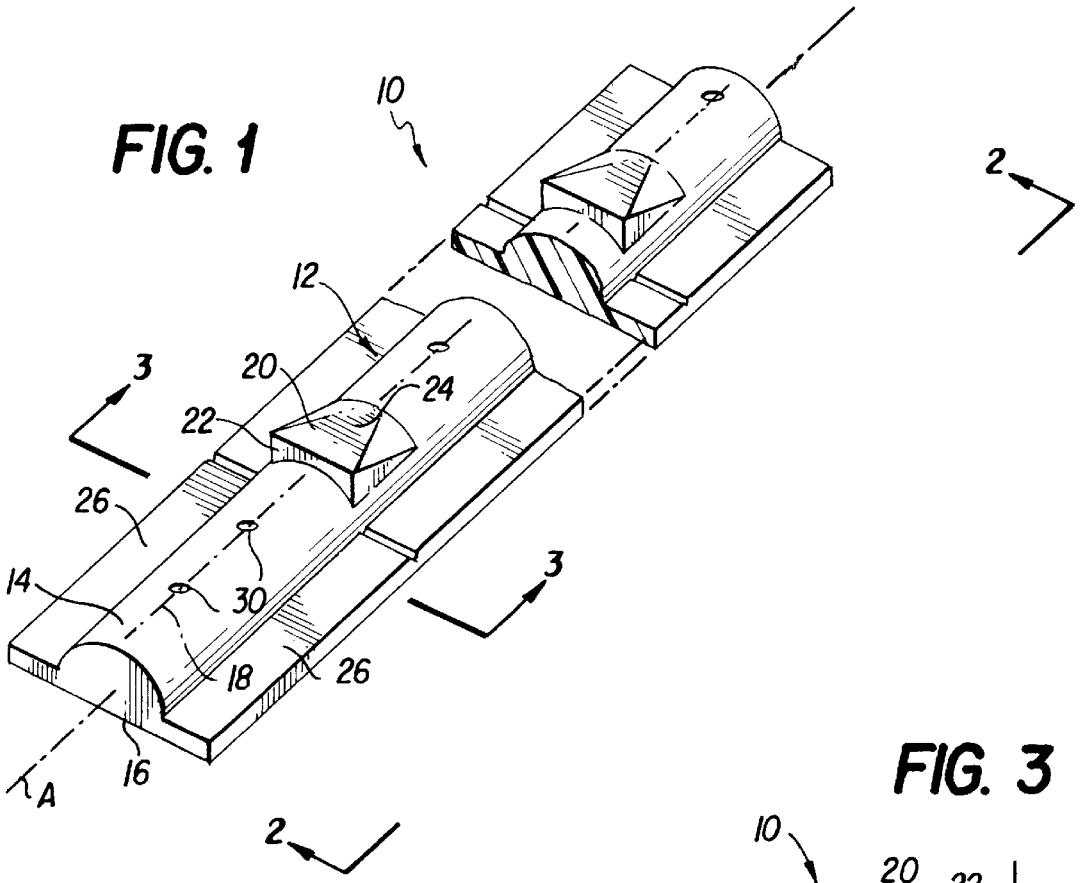
FIG. 1 is a perspective view of a first exemplary embodiment of an alignment and spacer apparatus of the invention.
Figure 3:
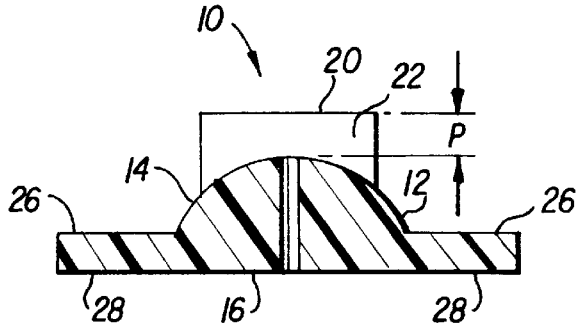
FIG. 3 is a bottom elevational view of the alignment and spacer apparatus of the invention taken along line 3—3 in FIG. 1.
Figure 2:
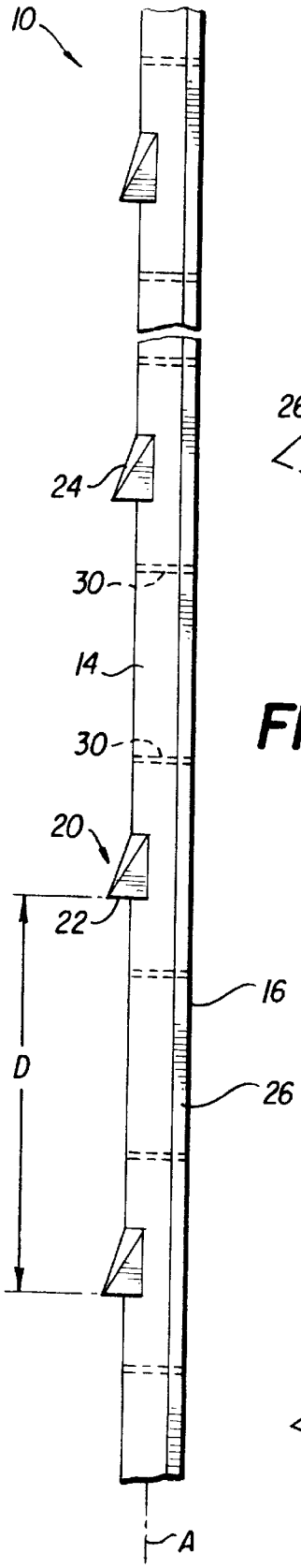
FIG. 2 is a side elevational view of the alignment and spacer apparatus of the invention taken along line 2—2 in FIG. 1.
Figure 4:
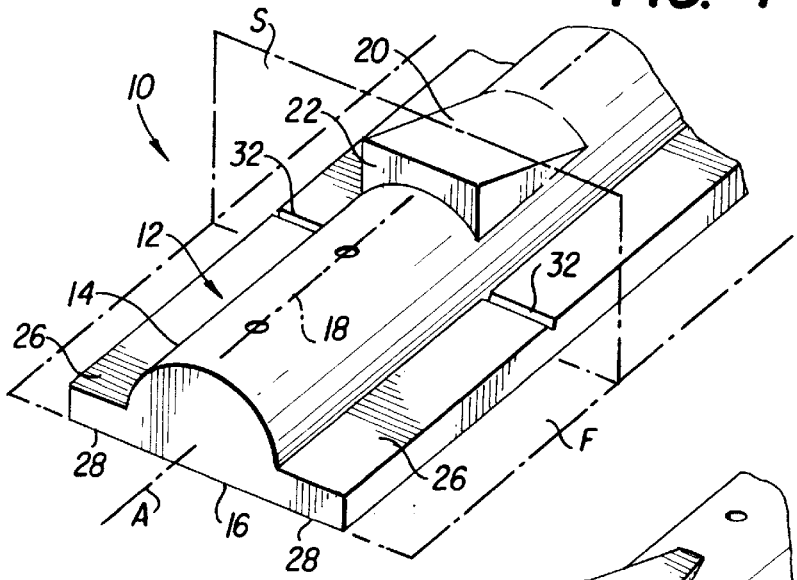
FIG. 4 is an enlarged partial perspective view of the alignment and spacer apparatus of the invention shown in FIG. 1.

An alignment and spacer apparatus 10 of the invention is introduced in FIGS. 1—4. The alignment and spacer apparatus 10 of the invention includes an elongated body member 12 that extends longitudinally along and laterally from a longitudinal axis A. The elongated body member 12 has an arcuate surface 14 and a flat surface 16. As best shown in FIGS. 2 and 3, the flat surface 16 faces opposite the arcuate surface 14. In FIGS. 1 and 4, the arcuate surface 14 curves about the longitudinal axis A to form in cross-section a D-shape and has a longitudinally extending crown 18 represented by a dashed line. One of ordinary skill in the art would appreciate that the crown 18 is a peak portion of the arcuate surface 14 as measured from the flat surface 16. Although not by way of limitation, the crown 18 is centrally disposed along the body member 12 and parallel with the longitudinal axis A.

In FIG. 1, the body member 12 also includes a sequence of stop tabs 20 spaced equidistantly apart from one another at a distance D. A skilled artisan would appreciate that the distance D generally represents a width of a siding panel which is discussed in detail below. Each stop tab 20 projects from the arcuate surface 14 and has a stop tab surface 22 which extends laterally and perpendicularly relative to the longitudinal axis A. A top surface 24 of the respective stop tabs 20 forms a plane that intersects the longitudinal axis A at an inclined angle. However, a skill artisan would appreciate that the top surface 24 could form a plane that extends parallel with the longitudinal axis A. As shown in FIG. 3, at least a portion P of the stop tab surface 22 protrudes above the crown 18. Preferably, the portion P protruding above the crown 18 is disposed equidistantly on opposite sides of the longitudinal axis A. In other words, it is preferred that the stop tab 20 straddles the longitudinal axis A.

For the first embodiment of the alignment and spacer apparatus 10 of the invention, the elongated body member 12 and the stop tabs 20 are fabricated as a unitary construction. Further, for the first embodiment of the alignment and spacer apparatus 10 of the invention, the body member 12 can be fabricated from either of a metal such as aluminum (FIG. 11) or a plastic (FIG. 3) such as vinyl. Thus, a metal body member 12 could be molded or stamped to form the stop tabs 20 and a plastic body member 12 could be molded to form the stop tabs 20.

Also, for the first embodiment of the alignment and spacer apparatus 10 of the invention, the body member 12 includes a pair of opposing flanges 26. Each flange 26 extends longitudinally along and laterally from the arcuate surface 14. As best shown in FIG. 3, each flange 26 has a flat flange surface 28. The flat flange surfaces 28 are disposed in a flat surface plane F (shown in FIG. 4) with the flat surface 16 of the body member 12. Thus, the flat flange surfaces 28 form a part of the flat surface 16 of the body member 12.

Additionally, for the first embodiment of the alignment and spacer apparatus 10 of the invention, the body member 12 includes a plurality of holes 30 as illustrated,in FIGS. 1—3. The plurality of holes 30 are spaced apart from one another and are preferably linearly aligned along the crown 18. Each hole 30 extends through the body member 12 between the arcuate surface 14 and the flat surface 16 and is sized to receive conventional fasteners such as nails and screws.

As best illustrated in FIG. 4, the alignment and spacer apparatus 10 of the invention includes alignment indicia 32 in a form of linear indentations etched into each flange 26. Although not by way of limitation, the indentations are configured in cross-section as V-shapes. The alignment indicia 32 are positioned adjacent the stop tabs and disposed in a stop tab plane S defined by the stop tab surface 22. The alignment indicia 32 are useful for vertically aligning the alignment and spacer apparatus 10 of the invention as explained below.

In FIGS. 5—8, another embodiment of the invention is a siding panel installation system 40. The siding panel installation system 40 is for installing siding panels 42 onto a support structure 44, such as a side of a house 46. Each siding panel 42 has a linear top edge 48 as illustrated in FIGS. 5 and 6. The siding panel installation system 40 includes a plurality of the elongated body members 12, such as the ones described above. Again, with reference to FIG. 5, the plurality of body members 12 are disposed apart from one another in a parallel relationship and are arranged to form a series of rows of stop tabs R1–RN. Each series R1–RN includes one stop tab 20 from each body member 12. Note that the stop tabs 20 in each series R1–RN are linearly aligned with each other.

Figure 7:
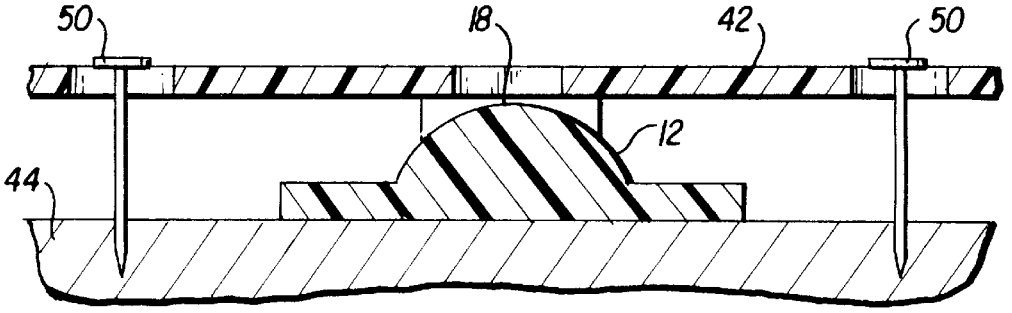
FIG. 7 is a bottom elevational view taken along line 7—7 in FIG. 6 of the house and the siding panel installation system of the invention including the plurality of alignment and spacer apparatuses with siding panels mounted thereto.
Figure 8:
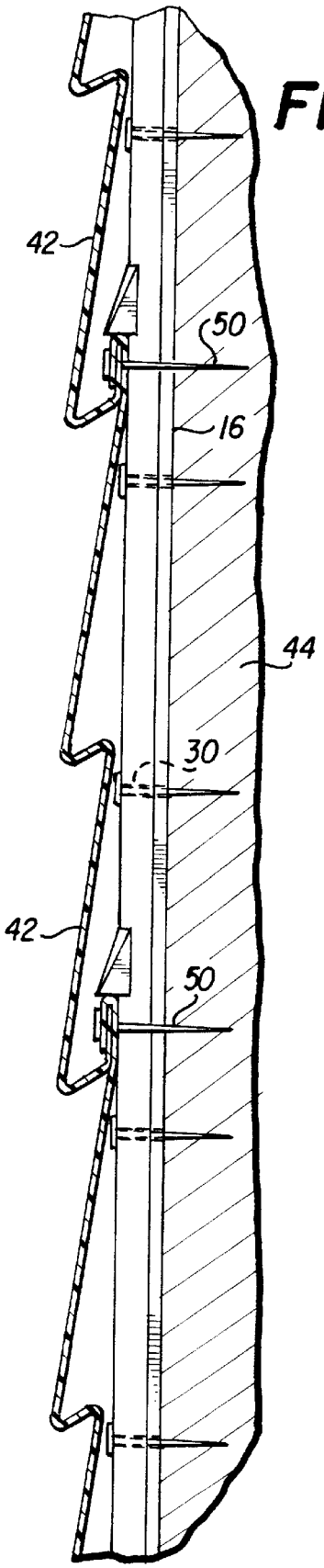
FIG. 8 is a side elevational view of the a plurality of siding panels mounted to the side of the house with the plurality of alignment and spacer apparatuses also mounted thereto and used as a spacer between the siding panels and the side of the house.

As shown in FIG. 8, the body members 12 are connected to the support structure 44 in a facially opposing relationship with the flat surfaces 16. The body members 12 are connected to the support structure 44 by conventional fasteners 48 extending through the holes 30 and into the support structure 44. As shown in FIG. 5, each one of the siding panels 42 is disposed crosswise relative to the plurality of body members 12 connected to the support structure 44. Also, each one of the siding panels 42 contact the body members 12 but only along the respective crowns 18 as best shown in FIG. 7. With such limited contact with the body member, less friction is generated when an installer slides the siding panel horizontally along the plurality of body members to achieve vertical alignment of the siding panels.

As best shown in FIG. 6, the linear top edge 48 of respective ones of the siding panels 42 abuts the stop tab surfaces in a respective row. When an installer urges such abutment, horizontal alignment of each siding panel 42 before being connecting to the support structure 44 is assured. When the respective ones of the siding panels 42 are connected to the support structure 44 by conventional fasteners, as shown in FIG. 6, the body member 12 provides a spacer between each connected siding panel 42 and the support structure 44.

Although not byway of limitation, the installer can snap a horizontal plumb line onto the support structure 44. Thereafter, the installer may align the alignment indicia 32 at a desired stop tab 20 with the horizontal plumb line to achieve vertical mounting of the alignment and spacer apparatuses 10 to the support structure 44. Alternatively, the bottom most siding panel is horizontally aligned and mounted to the support structure. Thereafter, the alignment and spacer apparatuses are positioned vertically between the bottom most siding panel and the support structure and the bottom most stop tab surfaces are urged to abut the top linear edge of the bottom most siding panel. Thus, the alignment and spacer apparatuses are vertically aligned with the support structure. Further, a skilled artisan would appreciate that other methods might be available to achieve proper vertical alignment of the alignment and spacer apparatuses before being connected to the support structure 44.

Figure 9:
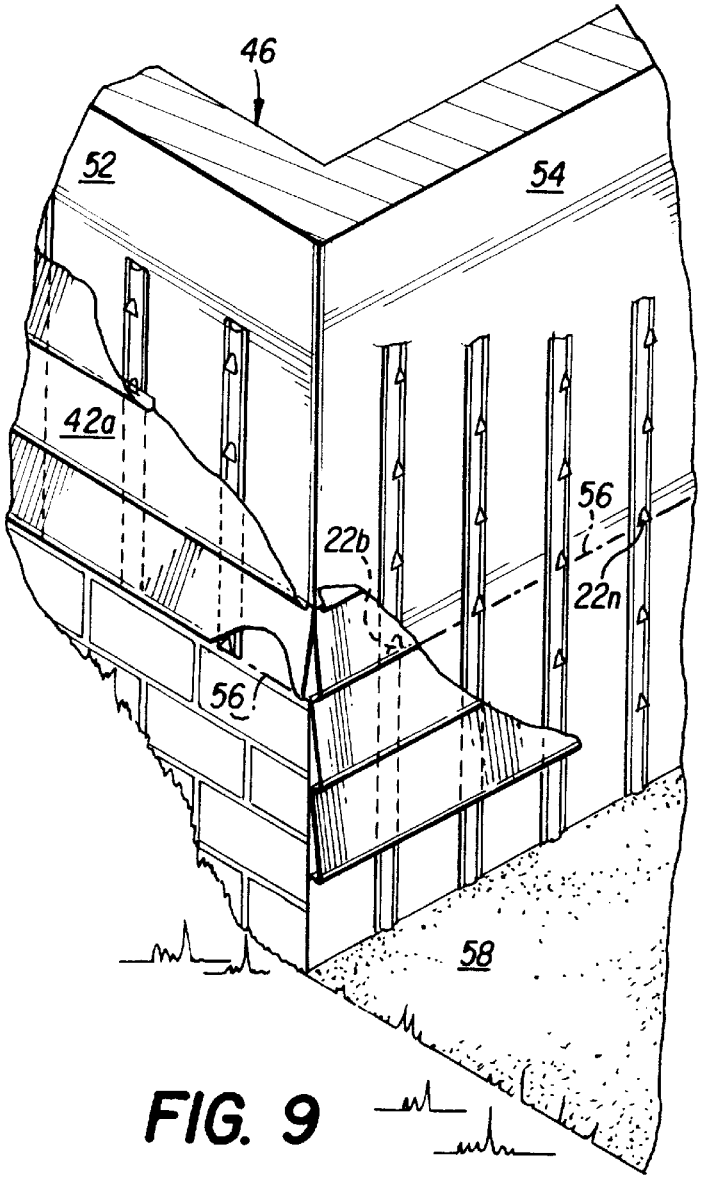
FIG. 9 is a perspective view of a comer of the house illustrating how the alignment and spacer apparatuses mounted on one side of the house are aligned to those on an adjoining side of the house.

In FIG. 9, the alignment indicia 32 is particularly useful when the siding panels 42 are mounted on one wall 52 of the house 46 and siding panels are required to be mounted on an adjoining wall 54 of the house 46. The horizontal line 56 being coextensive with the alignment indicia on, for example, siding panel 42*a* is extended to the comer of the house and is continued along the adjoining wall 54. The alignment indicia associated with selected stop tab surfaces, for example, 22*b*–22*n* on the respective alignment and spacer apparatuses, are then aligned with the horizontal line 56. In this instance, the selected stop tab surfaces are those that permit the alignment and spacer apparatuses to extend to, or extend closely to, the patio surface 58. Now, the bottom most siding panel for the adjoining wall can be accurately mounted. When the subsequent siding panels are thereafter mounted, horizontal alignment with the siding panels the adjoining walls is achieved.

Figure 10:
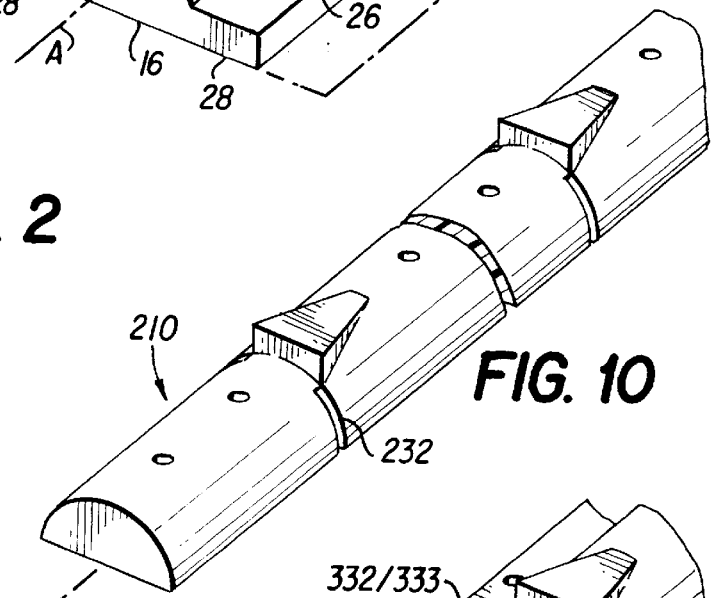
FIG. 10 is a perspective view of a second exemplary embodiment of the alignment and spacer apparatus of the invention.

A second embodiment of an alignment and spacer apparatus 210 of the invention is shown in FIG. 10. This alignment and spacer apparatus 210 of the invention is similar to the first embodiment except that there are no flanges that are included with the body member, thus forming a D-shaped configuration. Also, alignment indicia 232 adjacent each stop tab are a pair of printed lines although it is possible to have just one printed line adjacent each stop tab.

Figure 11:
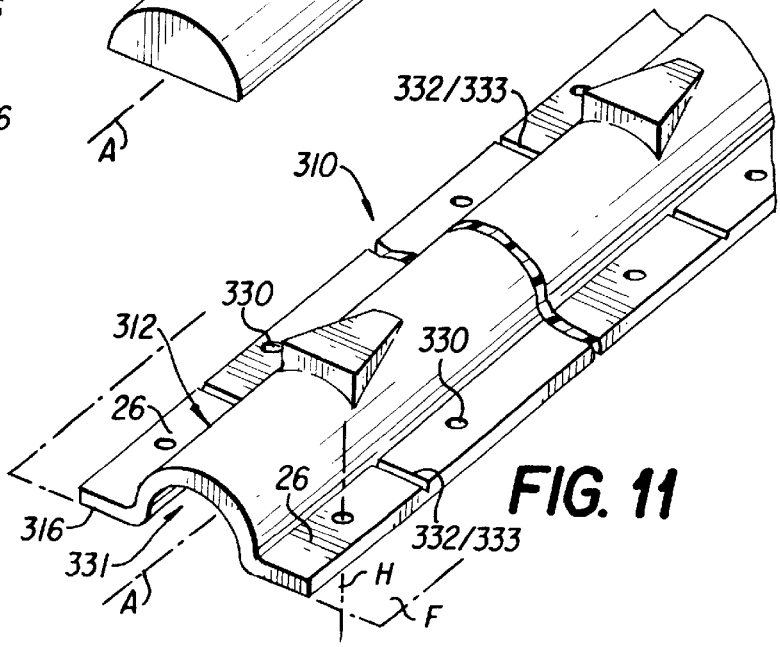
FIG. 11 is a perspective view of a third exemplary embodiment of the alignment and spacer apparatus of the invention.

A third embodiment of an alignment and spacer apparatus 310 of the invention is shown in FIG. 11. For this embodiment, each one of the pair of flanges 26 includes a plurality of mounting holes 330 extending therethrough along a hole axis H. The hole axis H is oriented perpendicularly to the flat surface plane F. The plurality of mounting holes 330 are aligned parallel with the longitudinal axis. Further, the alignment and spacer apparatus 310 of the invention includes a body member 312 having a longitudinally extending groove 331 formed into the flat surface 316. Although not by way of limitation, the groove 331 is arcuate in crosssection. Also, the alignment and spacer apparatus 310 is fabricated from metal and includes alignment indicia 332 in a form of protuberances 333. The protuberances 333 project from the body member 312.

A skilled artisan would appreciate that the siding panel installation system that includes a plurality of alignment and spacer apparatuses simplifies installation of siding panels onto a support structure. Also, the siding panel installation system can be employed to more rapidly install and more accurately align the siding panels for mounting onto a support structure, particularly with regard to adjoining walls. Further, the siding panel installation system enables the installer to slide the siding panels horizontally at a reduced amount of friction compared to conventional methods of siding panel installation.

The invention has been described with particularity in connection with the exemplary embodiments. However, it should be appreciated that changes may be made to the disclosed embodiments of the invention without departing from the spirit and inventive concepts contained herein.

What is claimed is:

1. An alignment and spacer apparatus, comprising:

an elongated body member extending longitudinally along and laterally from a longitudinal axis and having an arcuate surface and a flat surface facing opposite the arcuate surface, the arcuate surface curving about the longitudinal axis and having a longitudinally extending crown, the body member including at least one stop tab projecting from the arcuate surface to define a stop tab surface extending laterally and perpendicularly relative to the longitudinal axis with at least a portion of the stop tab surface protruding above the crown.

2. An alignment and spacer apparatus according to claim 1, the elongated body member and the stop tab are fabricated as a unitary construction.

3. An alignment and spacer apparatus according to claim 1, wherein the body member is generally configured in cross-section as a D-shape.

4. An alignment and spacer apparatus according to claim 1, wherein the body member includes a pair of opposing flanges, each flange extending longitudinally along and laterally from the arcuate surface with each flange having a flat flange surface disposed in a flat surface plane with the flat surface of the body member.

5. An alignment and spacer apparatus according to claim 4, wherein each one of the pair of flanges includes a plurality of holes extending therethrough along a hole axis oriented perpendicularly to the flat surface plane, the plurality of holes being aligned parallel with the longitudinal axis.

6. An alignment and spacer apparatus according to claim 1, wherein the body member includes a plurality of holes spaced apart from one another, each hole extending through the body member between the arcuate surface and the flat surface.

7. An alignment and spacer apparatus according to claim 6, wherein the plurality of holes are linearly aligned along the crown.

8. An alignment and spacer apparatus according to claim 1, wherein the body member is fabricated from one of a metal and a plastic.

9. An alignment and spacer apparatus according to claim 8, wherein the metal is aluminum and the plastic material is vinyl.

10. An alignment and spacer apparatus according to claim 1, further including alignment indicia positioned adjacent the stop tabs and disposed in a stop tab plane defined by the stop tab surface.

11. An alignment and spacer apparatus according to claim 10, wherein the alignment indicia is one of an indentation formed into the body member, a protuberance projecting from the body member and at least one printed line.

12. An alignment and spacer apparatus according to claim 1, wherein the body member includes a longitudinally extending groove formed into the flat surface.

13. An alignment and spacer apparatus according to claim 12, wherein the groove is arcuate in cross-section.

14. An alignment and spacer apparatus, comprising:

an elongated body member extending longitudinally along and laterally from a longitudinal axis and having an arcuate surface and a flat surface facing opposite the arcuate surface, the arcuate surface curving about the longitudinal axis and having a longitudinally extending crown, the body member including a sequence of stop tabs spaced equidistantly apart from one another and projecting from the arcuate surface, each stop tab having a stop tab surface extending laterally and perpendicularly relative to the longitudinal axis with at least a portion of the stop tab surface protruding above the crown and being disposed equidistantly on opposite sides of the longitudinal axis.

15. An alignment and spacer apparatus according to claim 14, wherein the body member includes a plurality of holes spaced apart from one another and linearly aligned along the crown, each hole extending through the body member between the arcuate surface and the flat surface.

16. An alignment and spacer apparatus according to claim 14, wherein the body member includes a pair of opposing flanges, each flange extending longitudinally along and laterally from the arcuate surface with each flange having a flat flange surface disposed in a flat surface plane with the flat surface of the body member.

17. An alignment and spacer apparatus according to claim 14, further including indicia positioned adjacent the stop tabs and disposed in a stop tab plane defined by the stop tab surface, the indicia being one of an indentation formed into the body member, a protuberance projecting from the body member and at least one printed line.

18. A siding panel installation system used for installing siding panels onto a support structure, each siding panel having a linear top edge, the siding panel installation system comprising:

a plurality of elongated body members, each one of the body members extending longitudinally along and laterally from a longitudinal axis and having an arcuate surface and a flat surface facing opposite the arcuate surface, the arcuate surface curving about the longitudinal axis and having a longitudinally extending crown, each body member including a sequence of stop tabs spaced equidistantly apart from one another and projecting from the arcuate surface, each stop tab having a stop tab surface extending laterally and perpendicularly relative to the longitudinal axis with at least a portion of the stop tab surface protruding above the crown and being disposed equidistantly on opposite sides of the longitudinal axis, whereby the plurality of body members are disposed apart from one another in a parallel relationship and are arranged to form a series of rows of stop tabs with each series including one stop tab from each body member linearly aligned and are connected to the support structure in a facially opposing relationship with the flat surfaces such that when each one of the siding panels is disposed crosswise relative to the plurality of connected body members and in contact with the respective crowns, the linear top edge of respective ones of the siding panels is urged to abut the stop tab surfaces in a respective row thereby assuring horizontal alignment of each siding panel before connecting each siding panel to the support structure and providing a spacer between each connected siding panel and the support structure.

* * * * *